US007065314B2

(12) United States Patent
Taguchi

(10) Patent No.: US 7,065,314 B2
(45) Date of Patent: Jun. 20, 2006

(54) COLOR IMAGE FORMING APPARATUS AND METHOD IN WHICH A PLURALITY OF IMAGES ARE FORMED ON A TONER IMAGE CARRIER

(75) Inventor: Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/862,064

(22) Filed: Jun. 4, 2004

(65) Prior Publication Data

US 2005/0008405 A1 Jan. 13, 2005

(30) Foreign Application Priority Data

Jun. 10, 2003 (JP) ..... 2003-164670
Jun. 10, 2003 (JP) ..... 2003-164671

(51) Int. Cl.
*G03G 15/01* (2006.01)

(52) U.S. Cl. ..... 399/298

(58) Field of Classification Search ..... 399/227, 399/298
See application file for complete search history.

(56) References Cited

U.S. PATENT DOCUMENTS 6,154,621 A * 11/2000 Yamamoto et al. ..... 399/68

FOREIGN PATENT DOCUMENTS

| | | |
|---|---|---|
| JP | 06-035262 | 2/1994 |
| JP | 07-137350 | 5/1995 |
| JP | 2000-275924 | 10/2000 |
| JP | 2001-228675 | 8/2001 |
| JP | 2002-333756 | 11/2002 |

* cited by examiner

*Primary Examiner*—Quana Grainger
(74) *Attorney, Agent, or Firm*—Hogan&Hartson LLP

(57) ABSTRACT

In an image forming apparatus capable of selectively carrying out a color print mode or a monochromatic print mode, the individual print modes are carried out as follows. In the color print mode, images are arranged on an intermediate transfer belt 71 with a first spacing d1(*a*) suited for the color print mode, the first spacing shorter than a second spacing d2(*a*). Hence, the second spacing d2(*a*) may be increased by the amount that the first spacing d1(*a*) is decreased, so that a sufficient time for the changeover of developers 4Y, 4M, 4C, 4K may be afforded. In the monochromatic print mode, on the other hand, adjustment is made to equate the first spacing d1(*a*) to the second spacing d2(*a*). This obviates a narrowed sheet spacing.

16 Claims, 9 Drawing Sheets

FIG. 4A: HOME POSITION
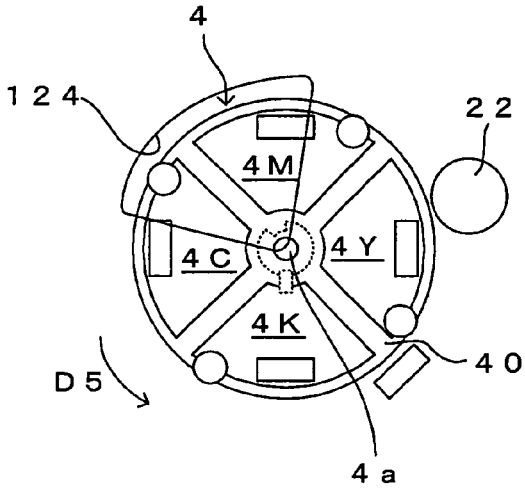
FIG. 4B: K-DEVELOPMENT POSITION (LEADING DEVELOPMENT POSITION)
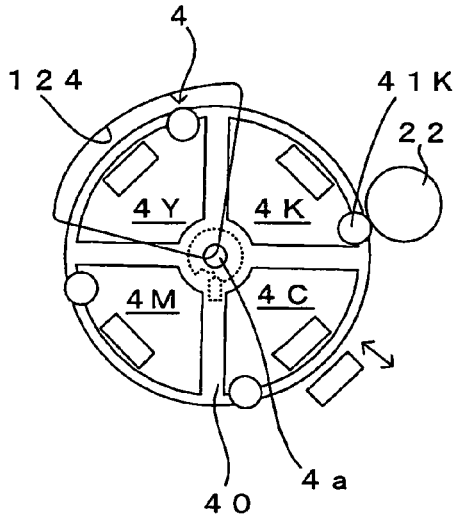
FIG. 4C: Y-DEVELOPMENT POSITION (FINAL DEVELOPMENT POSITION)
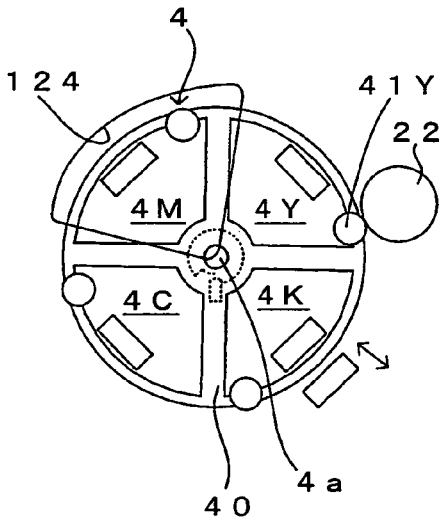
FIG. 4D: MOUNTING/DISMOUNTING POSITION
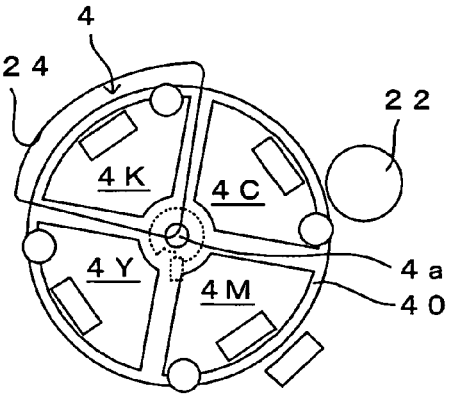

FIG. 5A: A3-SIZE
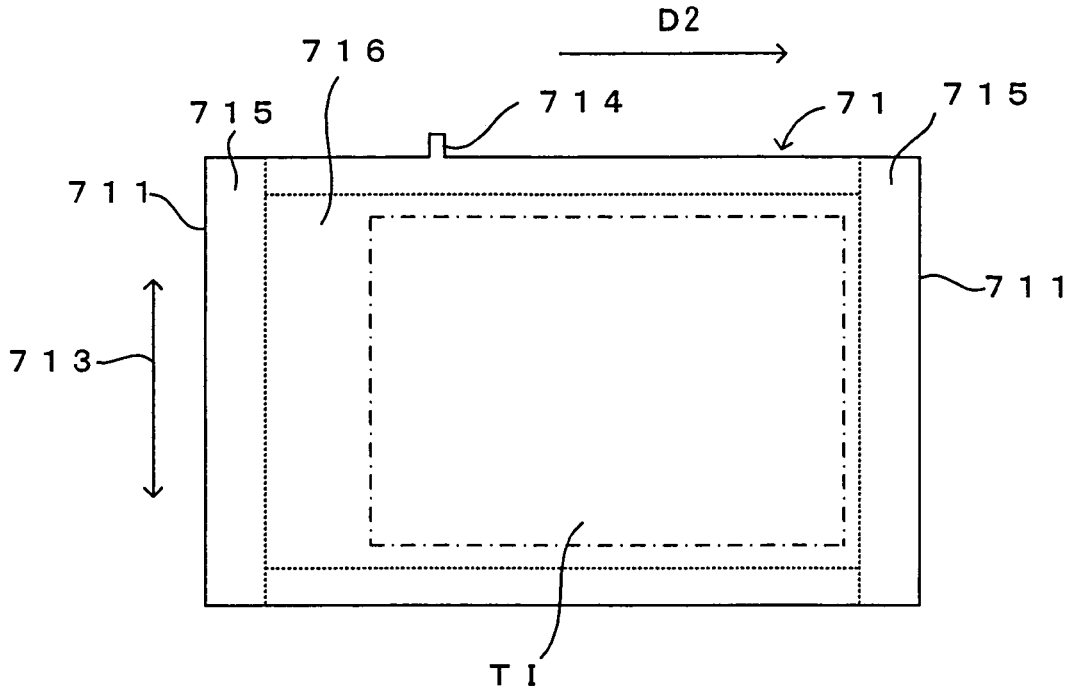
FIG. 5B: A4-SIZE
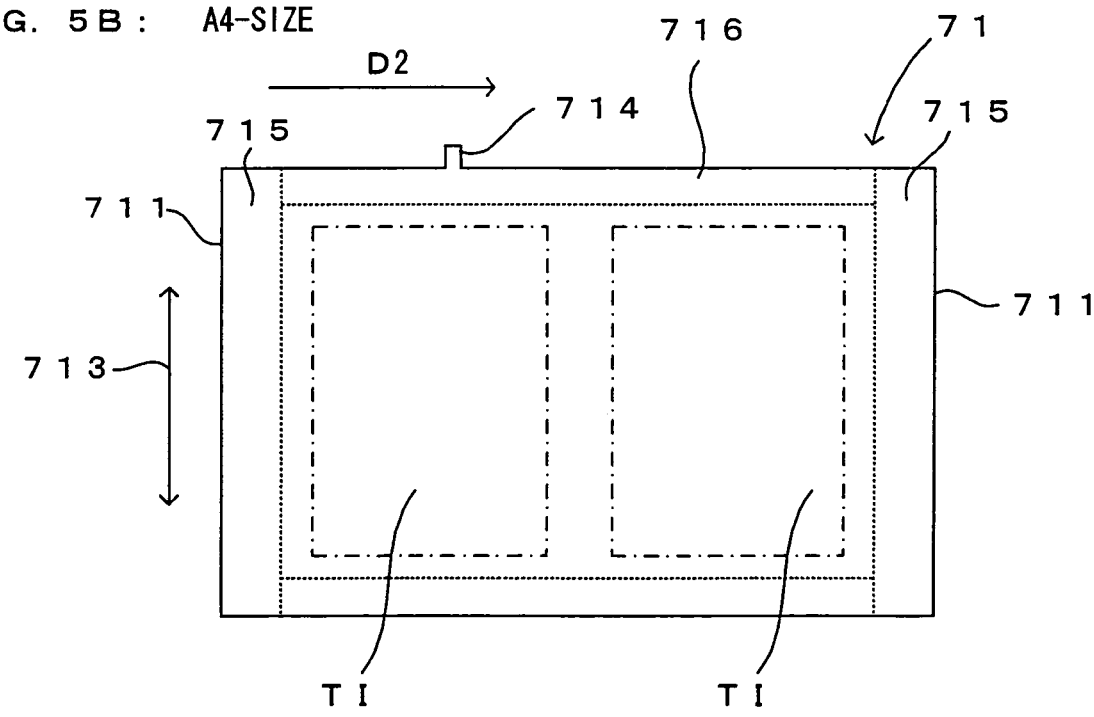

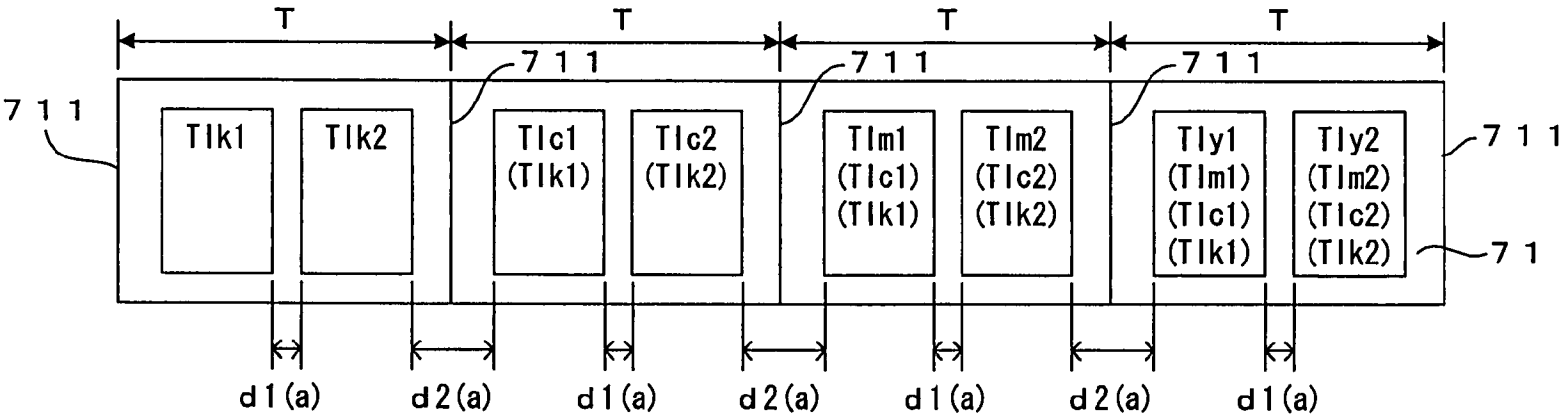
FIG. 6A : COLOR PRINT MODE : d1(a) < d2(a)
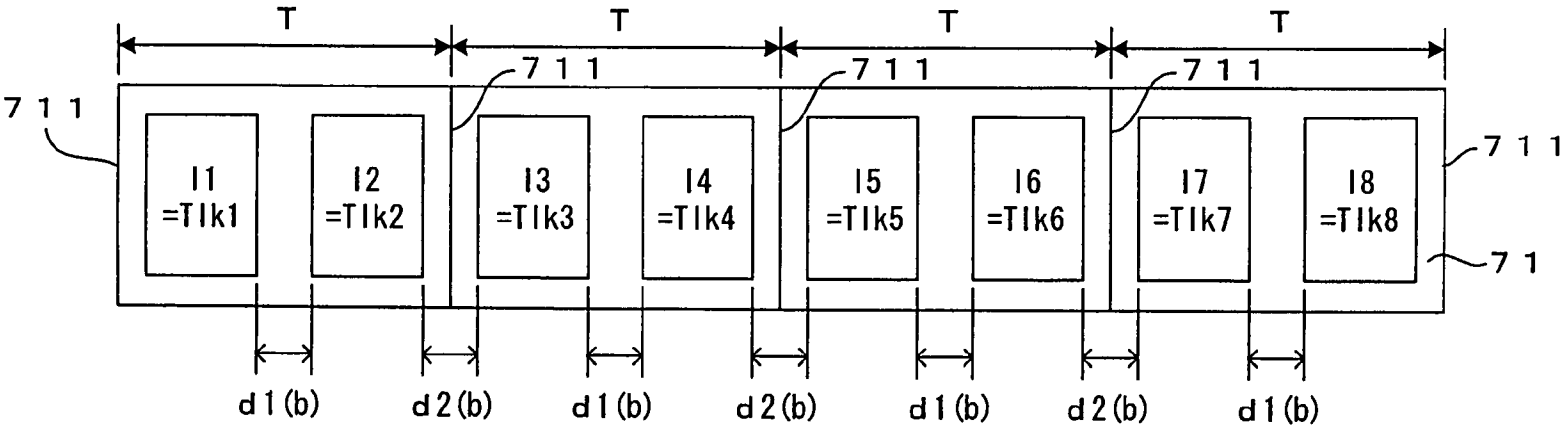
FIG. 6B : MONOCHROMATIC PRINT MODE : d1(b) = d2(b)

COLOR IMAGE FORMING APPARATUS AND METHOD IN WHICH A PLURALITY OF IMAGES ARE FORMED ON A TONER IMAGE CARRIER

CROSS REFERENCE TO RELATED APPLICATION

The disclosure of Japanese Patent Applications No. 2003-164670 filed Jun. 10, 2003 and No. 2003-164671 filed Jun. 10, 2003 each of which includes specification, drawings and claims is incorporated herein by reference in its entirely.

BACKGROUND OF THE INVENTION

1. Field of the Invention

The present invention relates to an image forming apparatus and method for forming a color image by superimposing a plurality of toner images of different colors on top of each other on an image carrier such as a transfer belt, a transfer drum or a transfer sheet.

2. Description of the Related Art

As the image forming apparatus of this type, there is known one disclosed in Japanese Unexamined Patent Publication No. 2002-333756, for example. The apparatus forms a full color image by superimposing toner images of four colors of yellow (Y), magenta (M), cyan (C) and black (K) on an intermediate transfer belt, or forms a monochromatic image using a black (K) toner alone. The apparatus is provided with a rotary developing unit wherein developers of four colors are arranged radially. The developing unit is adapted to make changeover of the developers by selectively transferring any one of the developers to a predetermined development position where the selected developer is pressed against a latent image carrier such as a photosensitive member, or opposes the latent image carrier via a predetermined gap therebetween. The developer positioned at the development position develops a latent image on the latent image carrier so as to form a toner image, while the toner image is transferred onto the intermediate transfer belt moved in a given direction (image forming process). The apparatus is arranged such that after power-on or completion of the preceding printing operations, the rotary developing unit is rotated to be positioned at a predetermined standby position (home position) to wait for a printing command. The rotary developing unit waits for the printing command as positioned at the standby position.

When a color print command is applied from an external apparatus, for instance, toner images of four different colors are formed by performing the image forming process at each changeover from one developer to another and are superimposed on top of each other on the intermediate transfer belt so as to form a color image (color print mode). Specifically, the rotary developing unit is rotated to position the developer of black, as an initial color, at the predetermined development position. Then, the latent image on the latent image carrier is developed with a black toner so as to form a black toner image, which is primarily transferred onto the intermediate transfer belt. Subsequently, the same procedure as that for forming the black toner image is repeated in cycles thereby forming toner images of cyan (C), magenta (M) and yellow (Y) in this order. The resultant toner images are superimposed on top of each other on the intermediate transfer belt thereby forming a color image. After the completion of the development of the toner image of the final color, which is yellow, the rotary developing unit is returned to the standby position. When a monochromatic print command is applied from the external apparatus such as a host computer, on the other hand, the developer of black is transferred to the predetermined development position where the developer performs the image forming process for forming a monochromatic image on the intermediate transfer belt (monochromatic print mode).

In a case where the image forming apparatus of this arrangement forms an image of a relatively small size, a plurality of such images are arranged on the intermediate transfer belt. In conventional printers (image forming apparatuses), various types of which have been provided and which are capable of forming an image of A3 size in maximum, an arrangement is made such that two A-4 size images are formed and arranged in side-by-side relation on the intermediate transfer belt. Thus is achieved an increased throughput.

SUMMARY OF THE INVENTION

In the aforementioned image forming apparatus, an operation for making changeover of the developers differs greatly between the color print mode to form the color image and the monochromatic print mode to form the monochromatic image. In the monochromatic print mode, the toner images are successively formed without making changeover of the developers. In the color print mode, however, the image forming process is repeated while the four developers are switched from one to another in a given order. Hence, it is desired to make contemplation on a design to rearrange the image forming positions on the intermediate transfer belt according to the need for making the changeover of the developers.

In the conventional apparatuses, however, plural images are always arranged on the intermediate transfer belt in a given pattern regardless of whether the printing operations are performed in the color print mode or in the monochromatic print mode. Accordingly, the apparatuses can only provide control adapted for either one of the color print mode and the monochromatic print mode. There still exist some points to be improved in this respect. For instance, the color print mode requires the changeover of the developers. It is therefore desirable that a plurality of images are formed on the intermediate transfer belt in a manner suited for the changeover of the developers such that the developers may preferably be switched from one to another. In contrast, the monochromatic print mode negates the need for the changeover of the developers. In this mode, monochromatic images are successively formed on the intermediate transfer belt so that these images need be sequentially transferred to sheets such as transfer sheets or copy sheets, which are successively delivered from a sheet storage section such as a sheet cassette. Thus, this mode does not require considerations to be given to the changeover of the developers. It is rather desired that the image forming operations are performed with importance placed on the prevention of sheet jam. As described above, the requirements for the arrangement of the images on the intermediate transfer belt vary from one print mode to another. Unfortunately, the prior art has been unable to meet the requirements adequately.

In the aforementioned image forming apparatus, the rotary developing unit is returned to the standby position after the color image is formed according to the print command. However, there may be a case where the above print command is succeeded by the next print command. In the case of a successive printing of plural color images, for example, print commands are successively generated. In another case where the image forming apparatus is connected with a plurality of external apparatuses via a network, the individual external apparatuses apply their print commands to the image forming apparatus. When a color print signal and another print signal are supplied substantially at a time, the image forming apparatus may print such images in succession. In such a case of successive printing operations, the conventional apparatus cannot perform the successive printing operations efficiently because the rotary developing unit is returned to the standby position each time each of the printing operations is completed.

It is a primary object of the invention to optimize the arrangement of N images (N≧2) formed on the image carrier in each of the print modes of the image forming apparatus which is capable of selectively carrying out the color print mode or the monochromatic print mode.

It is another object of the invention to provide an image forming apparatus and an image forming method wherein the printing operations are efficiently performed regardless of whether the print commands are successively applied or not.

According to a first aspect of the present invention, N(N≧2) images are arranged on a toner image carrier along a moving direction. A first spacing between the M-th image (M representing a natural number of less than N) and the (M+1)-th image is adjusted so that a color print mode and a monochromatic print mode are different from each other in the first spacing.

According to a second aspect of the present invention, a color print mode is carried out. In the color print mode, a plural toner images form by performing a developing process each time any one of plural developers is positioned at a predetermined development position according to a print command and the plural toner images are superimposed on top of each other. The developing process is defined as a step of forming the toner image by developing a latent image on a latent image carrier by means of any one of the plural developers that is positioned at the development position by rotatably moving a developing unit. A check for the receipt of the succeeding print command is made within the lapse of a given time period from the completion of the developing process for a final color which is executed lastly of the plural colors. If the print command is received, the color print mode is carried out based on the received print command whereas if the print command is not received, the developing unit is moved to a predetermined standby position.

According to a third aspect of the present invention, a developing unit including the plural developers is rotatably moved thereby being positioned at a final development position, a leading development position and a standby position in the order named. The leading development position is defined as a position at which the developing unit presents to the development position a developer of a leading color executed firstly of the plural colors. The final development position is defined as a position at which the developing unit presents to the development position a developer of a final color executed lastly of the plural colors. The standby position is defined as a position at which the developing unit waits for a print command. After the completion of the developing process for the final color, the developing unit is rotatably moved to be positioned at a leading development position regardless of whether the succeeding print command is received or not.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 4A to 4D are schematic diagrams each showing a stop position of a developing unit;

FIGS. 5A and 5B are developed views each showing an arrangement of an intermediate transfer belt;

FIGS. 6A and 6B are schematic diagrams each showing the operations of the image forming apparatus of FIG. 1.

DETAILED DESCRIPTION OF THE PREFERRED EMBODIMENTS

First Embodiment

Figure 1:
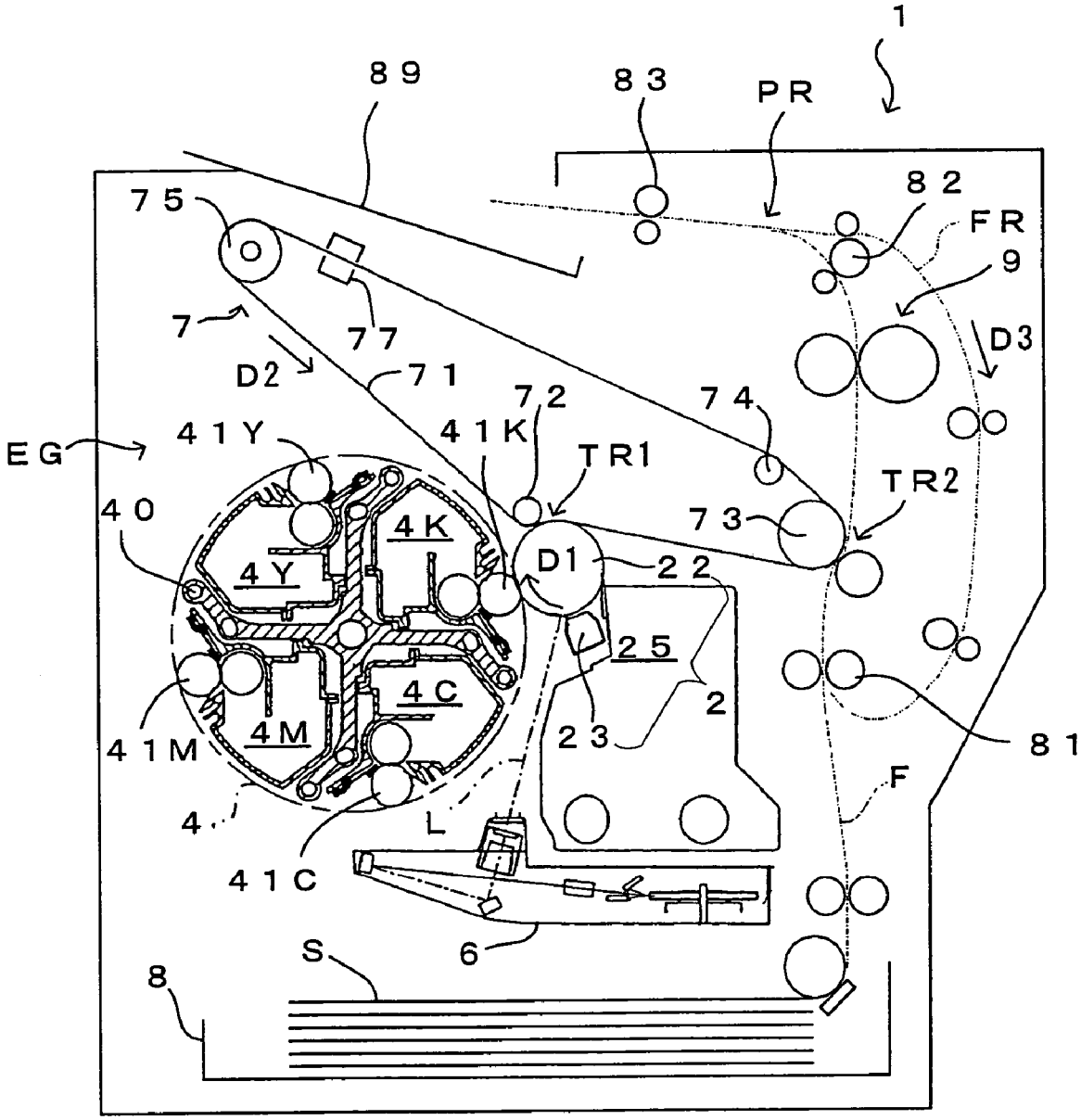
FIG. 1 is a diagram showing an image forming apparatus according to a first embodiment of the invention.
Figure 2:
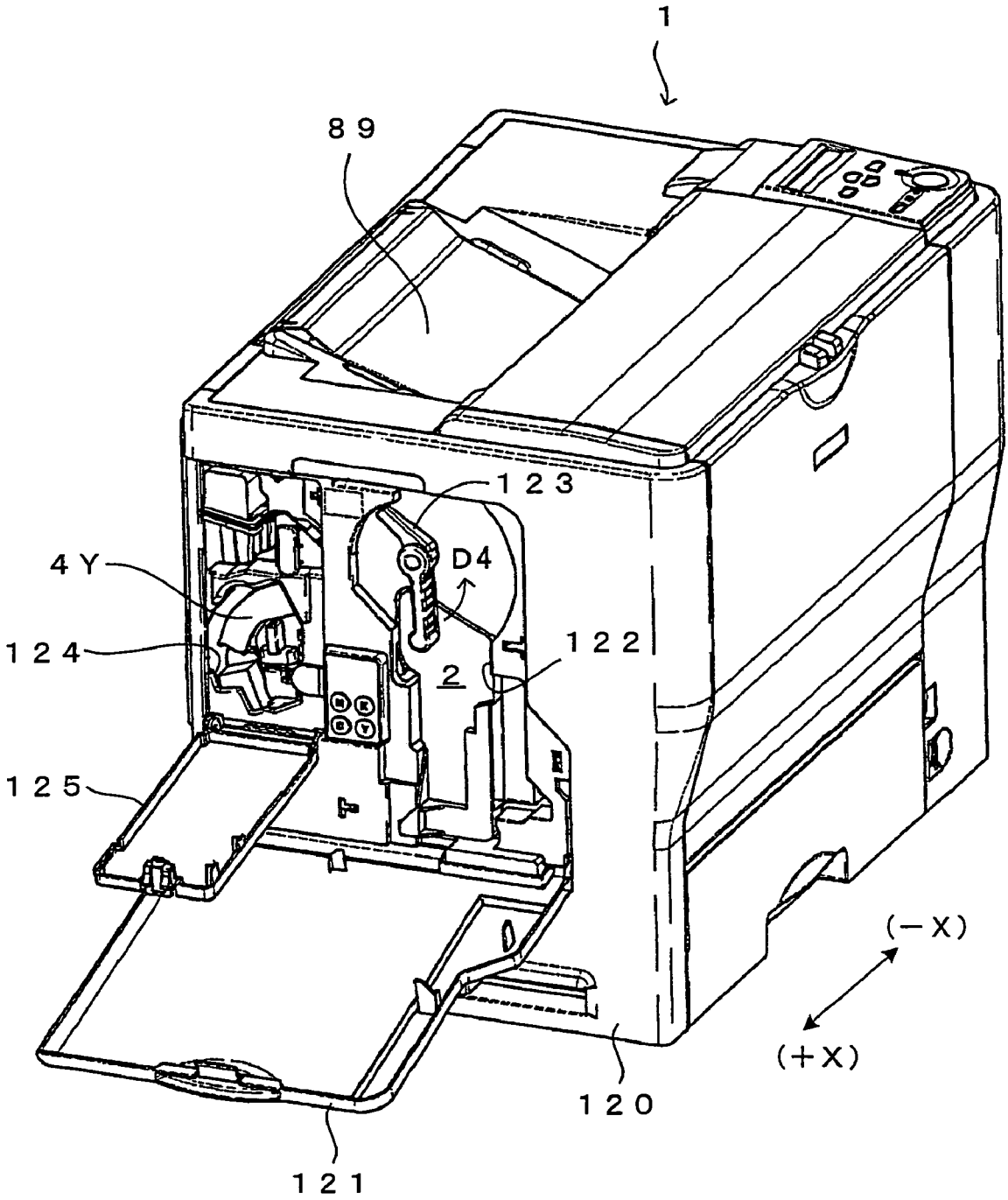
FIG. 2 is an external perspective view of the image forming apparatus of FIG. 1.
Figure 3:
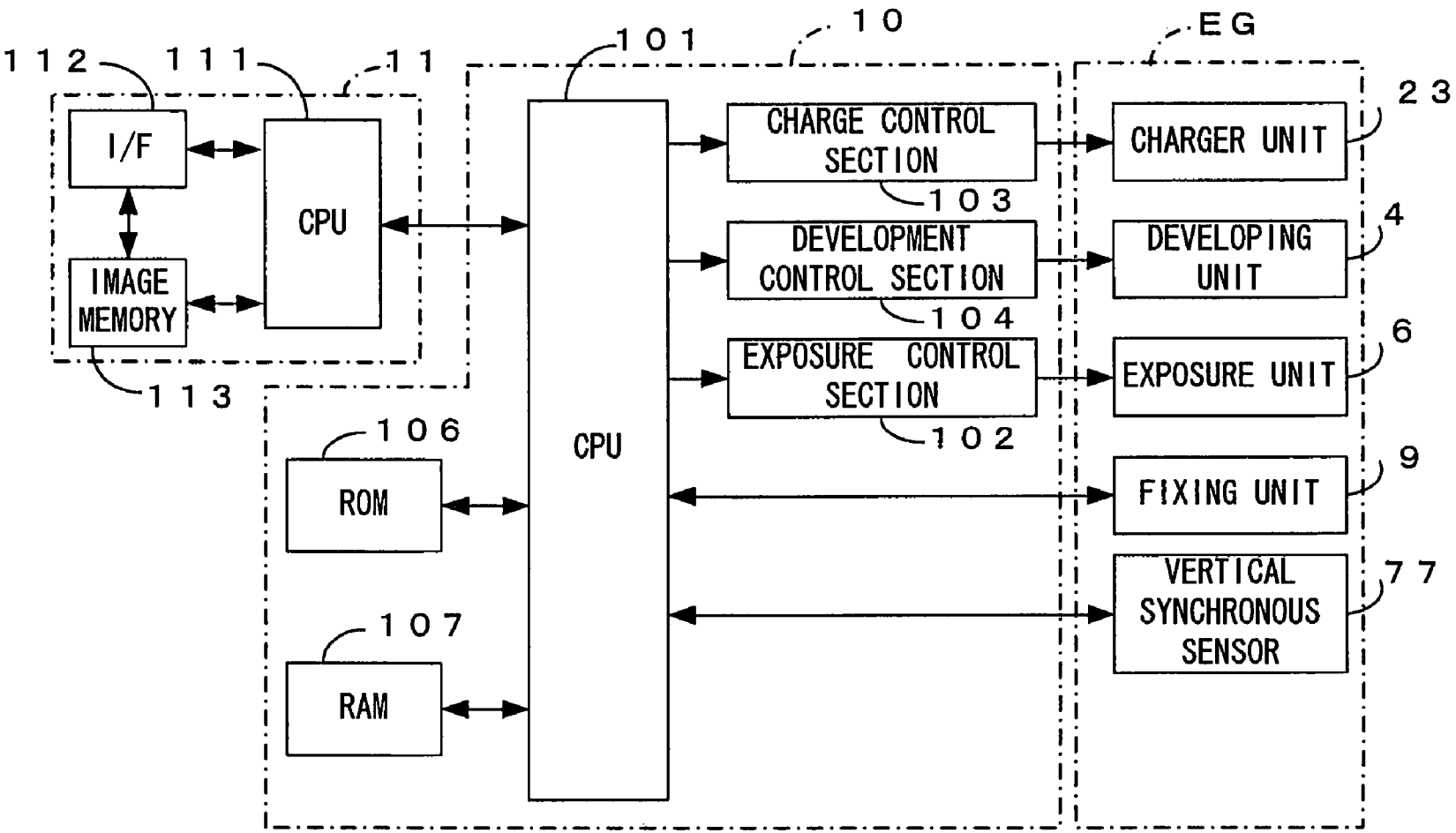
FIG. 3 is a block diagram showing an electrical arrangement of the image forming apparatus of FIG. 1.

FIG. 1 is a diagram showing an image forming apparatus according to a first embodiment of the invention. FIG. 2 is an external perspective view of the image forming apparatus of FIG. 1. FIG. 3 is a block diagram showing an electrical arrangement of the image forming apparatus of FIG. 1. The apparatus 1 is an image forming apparatus adapted to form a full color image by superimposing four color toners (developing agent) of yellow (Y), magenta (M), cyan (C) and black (K) (color print mode), and to form a monochromatic image using the toner of black (K) alone (monochromatic print mode). The image forming apparatus 1 operates as follows. When an external apparatus such as a host computer applies a print signal including an image signal to a main controller 11 via an interface 112, a CPU 111 of the main controller 11 converts the print signal into job data in a format suited for directing the operations of an engine EG and then outputs the resultant data to an engine controller 10. The engine controller 10, in turn, controls individual parts of the engine EG based on the job data sent from the CPU 111 so as to selectively carry out the color print mode or the monochromatic print mode for forming an image on a sheet S in correspondence to the image signal.

The engine EG is provided with a photosensitive member 22 rotatable along a direction of an arrow D1 as seen in FIG. 1. A charger unit 23, a rotary developing unit 4 and a cleaner 25 are arranged around the photosensitive member 22 along the rotational direction D1 thereof. The charger unit 23 is applied with a charging bias from a charge control section 103 so as to uniformly charge an outer periphery of the photosensitive member 22 to a predetermined surface potential. The photosensitive member 22, the charger unit 23 and the cleaner 25 are integrated into a photosensitive member cartridge 2. The photosensitive member cartridge 2 is designed to be bodily mounted to or dismounted from a main body of the apparatus 1, as shown in FIG. 2.

As shown in FIG. 2, the image forming apparatus 1 is provided with an openable outside cover 121 at a lateral side of an apparatus body 120 thereof. When a user, a service engineer or such opens the outside cover 121, a lateral side of the photosensitive member cartridge 2 is exposed via an aperture 122 for photosensitive member which is formed at the apparatus body 120. The photosensitive member cartridge 2 is released from a locked state by turning a lock lever 123 in a direction of an arrow D4, the lock lever serving to fix the photosensitive member cartridge to place. Thus, the photosensitive member cartridge 2 can be pulled out along a direction (+X) as shown in FIG. 2. On the other hand, a new photosensitive member cartridge 2 may be mounted to the apparatus body 120 by inserting the photosensitive member cartridge 2 through the aperture 122 for photosensitive member along a direction (−X) as shown in FIG. 2. Subsequently, the photosensitive member cartridge 2 is fixed to place by means of the lock lever 123. When the photosensitive member cartridge 2 is mounted in this manner, the aperture 122 for photosensitive member is substantially closed by the lateral side of the photosensitive member cartridge 2.

In the photosensitive member cartridge 2 mounted to the apparatus body 120 in the aforementioned manner, an exposure unit 6 irradiates a light beam L onto the outer periphery of the photosensitive member 22 charged by the charger unit 23. The exposure unit 6 irradiates the light beam L on the photosensitive member 22 according to a control command applied from an exposure control section 102 so as to form an electrostatic latent image corresponding to the image signal. When the external apparatus such as a host computer applies the image signal to the CPU 111 of the main controller 11 via an interface (I/F) 112, a CPU 101 of the engine controller 10 outputs a control signal corresponding to the image signal to the exposure control section 102 in a predetermined timing. In response to the control signal, the exposure unit 6 irradiates the light beam L on the photosensitive member 22 so that the electrostatic latent image corresponding to the image signal is formed on the photosensitive member 22. According to the embodiment, the photosensitive member 22 is equivalent to a "latent image carrier" of the invention.

The electrostatic latent image thus formed is developed into a toner image by means of the developing unit 4. In this embodiment, the developing unit 4 includes: a support frame (support member) 40 adapted to rotate about an axis; an unillustrated rotary drive portion; and a yellow developer 4Y, a magenta developer 4M, a cyan developer 4C and a black developer 4K which are each designed to be removably mounted to the support frame 40 and which each contain therein a toner of a color individual thereto. The apparatus body 120 is arranged in the following manner to permit the developers 4Y, 4M, 4C, 4K to be mounted thereto or dismounted therefrom. Specifically, the apparatus body 120 is provided with an aperture 124 for developer such that the developers 4Y, 4M, 4C, 4K may be mounted to or dismounted from the apparatus body via the aperture, as shown in FIG. 2. In addition, the apparatus body is provided with an openable inside cover 125 in a manner to cover the aperture 124 for developer. The inside cover 125 is disposed inwardly from the outside cover 121. That is, the outside cover 121 is so formed as to also cover the aperture 124 for developer and hence, it is impossible to open the inside cover 125 in a state where the outside cover 121 is closed. Conversely, it is impossible to close the outside cover 121 unless the inside cover 125 is closed. If the developing unit 4 is halted at a predetermined mounting/dismounting position when the user opens the inside cover 125, then the user can remove one of the mounted developers via the aperture 124 for developer. Additionally, the user can mount one developer via the aperture 124 for developer. Furthermore, the arrangement is made such that the rotary drive portion is operated thereby to position each of the developers 4Y, 4M, 4C, 4K at any of the following positions.

FIGS. 4A to 4D are schematic diagrams each showing a stop position of the developing unit. The developing unit 4 is driven into rotation in a direction of an arrow D5 based on a control command from the CPU 101 and is positioned at and locked to any of three positions by means of the CPU 101 and an unillustrated rotary locking mechanism. The three positions include: (a) a home position; (b) a development position (read/write position); and (c) a mounting/dismounting position. Of these, the (a) home position is a position at which the developing unit is positioned when the image forming apparatus is in a standby state where the image forming operation is not performed. Specifically, as shown in FIG. 4A, the developing unit is positioned in a state where each of the developers 4Y and such has its developing roller 41Y and such spaced away from the photosensitive member 22, and where any one of the developers 4Y, 4M, 4C, 4K cannot be removed via the aperture 124 for developer provided at the apparatus body 120. The apparatus waits for the print command with the developing unit 4 positioned at the home position. According to the embodiment, the home position is equivalent to a "standby position" of the invention.

The (b) development position is a position at which the developing unit 4 is positioned when the electrostatic latent image on the photosensitive member 22 is developed with a toner of a selected color. FIGS. 4B and 4C individually show the developing unit 4 positioned at a development position for black and at a development position for yellow, respectively. Specifically, FIG. 4B depicts a developing roller 41K brought into face-to-face relation with the photosensitive member 22, the roller provided at the developer 4K of black, as a leading color of the color print mode (leading development position). FIG. 4C depicts a developing roller 41Y brought into face-to-face relation with the photosensitive member 22, the roller provided at the developer 4Y of yellow, as a final color of the color print mode (final development position). At each development position, the developing roller is applied with a predetermined developing bias thereby to develop the electrostatic latent image with the toner. When the developing unit 4 is positioned at this development position, as well, it is impossible to dismount any one of the developers via the aperture 124 for developer. In a case where the outside cover 121 is opened during the image forming operation, the image forming operations are immediately stopped whereas the developing unit 4 is moved to the home position before it is deactivated.

The (c) mounting/dismounting position is a position that the developing unit 4 can take only when the developer is mounted or dismounted. When the developing unit 4 is positioned at the mounting/dismounting position, one of the developers appears at the aperture 124 for developer, as shown in FIG. 4D, so that the developer may be removed via the aperture 124. FIG. 4D depicts the developer 4K of black exposed from the aperture 124 for developer. This state also permits a new developer to be mounted to the support frame 40 in place where the developer is not mounted. At the mounting/dismounting position, all the developing rollers disposed at the respective developers are spaced away from the photosensitive member 22. Thus, the arrangement is made such that the developing unit 4 permits the removal of only one of the developers that is exposed from the aperture 124 for developer when the developing unit 4 is positioned at the mounting/dismounting position. This eliminates a fear that the user may cause damage to the apparatus by inadvertently mounting or dismounting the developer.

In this image forming apparatus, the aforesaid development position and mounting/dismounting position are defined for each of the four developers 4Y, 4M, 4C, 4K and hence, the developing unit 4 has nine stop positions in total, inclusive of one home position.

The developing unit 4 is controlled by a development control section 104, as shown in FIG. 3. The developing unit 4 is driven into rotation based on a control command from the development control section 104. In the meantime, any one of the developers 4Y, 4C, 4M, 4K is selectively positioned at the predetermined development position to abut against the photosensitive member 22 or to oppose the photosensitive member via a predetermined gap therebetween. Furthermore, the development control section 104 applies the developing bias to the developing roller 41 of the developer positioned at the development position, thereby allowing the developing roller 41 to supply the toner carried thereon to the photosensitive member 22. Thus, the electrostatic latent image on the photosensitive member 22 is developed in a selected toner color.

The toner image developed by the developing unit 4 in the aforementioned manner is primarily transferred onto an intermediate transfer belt 71 of a transfer unit 7 in a primary transfer region TRI. The transfer unit 7 includes the intermediate transfer belt 71 entrained about a plurality of rollers 72–75, and a driver (not shown) operative to drive the roller 73 into rotation thereby rotating the intermediate transfer belt 71 in a predetermined moving direction D2.

FIGS. 5A and 5B are developed views each showing an arrangement of the intermediate transfer belt. As shown in FIGS. 5A and 5B, the intermediate transfer belt 71 comprises an endless belt formed by joining substantially rectangular sheet members with each other at seams 711. The intermediate transfer belt is equivalent to the "toner image carrier" of the invention. In the figures, an arrow 713 indicates a direction of a rotary axis. The intermediate transfer belt 71 includes a projection 714 formed at one end thereof with respect to the rotary axis direction 713 (the upper side as seen in the figures), as well as a transfer inhibition region 715 and a transfer permission region 716. The transfer inhibition region 715 is defined by an area on either side of the seam 711, the area having predetermined dimensions and extending from one end to the other end of the intermediate transfer belt with respect to the rotary axis direction 713. On the other hand, the transfer permission region 716 is located centrally of the surface of the intermediate transfer belt 71 and is defined by a rectangular area excluding the opposite end portions of the intermediate transfer belt with respect to the rotary axis direction 713. The toner image is primarily transferred to the transfer permission region 716.

As shown in FIG. 5A, the transfer permission region 716 is designed to permit the transfer of a toner image TI of an A3 size, a longitudinal side of which extends in the rotational drive direction D2. In addition, as shown in FIG. 5B, the intermediate transfer belt 71 also permits the transfer of two toner images of an A4 size or less, such as A4, A5 or B5, the images carried substantially on the overall length thereof. The toner images are arranged in a manner to direct the shorter side thereof along the rotational drive direction D2. FIG. 5B shows the toner images TI of A4 size. In this embodiment, two toner images TI of A4 size or less are juxtaposed in the transfer permission region 716 along the rotational drive direction D2. However, as will be described hereinlater, the engine controller 10 controls such that the placement of the toner image TI on the intermediate transfer belt 71 may vary according to the color print mode or the monochromatic print mode.

A vertical synchronous sensor 77 comprises a photo-interrupter including a light emitting portion (such as an LED) and a photo-detector (such as a photo-diode) which are disposed in face-to-face relation. The vertical synchronous sensor is disposed near one end of the rotated intermediate transfer belt 71 with respect to the rotational axis direction 713, so as to detect the passage of the projection 714 and to output a detection signal. Thus, the projection 714 is defined as a "detection object" of the invention and the sensor 77 functions as a "detector" of the invention. The detection signal outputted from the vertical synchronous sensor 77 at each detection of the projection 714 is used as a vertical synchronous signal which serves as a reference for the image forming process controlled by the CPU 101 of the engine controller 10. That is, the individual parts of the engine EG operate in synchronism with the vertical synchronous signal whereby the image forming process is carried out. The "image forming process" means to include: a step of forming the toner image TI by developing the latent image on the photosensitive member 22 by means of any one of the developers 4Y, 4M, 4C, 4K that is selectively transferred to the development position (image forming step); and a step of transferring the resultant toner image TI to the intermediate transfer belt 71 moved in the predetermined moving direction D2. That is, toner images of four colors are formed by performing the image forming process each time the developers 4Y, 4M, 4C, 4K are switched from one to another and then, the toner images of four colors are superimposed on top of each other on the intermediate transfer belt 71 whereby a color image is formed (color print mode). The color image is formed in this manner and is secondarily transferred to the sheet S taken out from a cassette 8 on a sheet-by-sheet basis and transported along a transport path F to a secondary transfer region TR2.

In a case where a monochromatic image is transferred to the sheet S, on the other hand, the monochromatic image is formed by performing the image forming process for black color (monochromatic print mode). Subsequently, the same procedure as that for the color image is taken to transfer the resultant monochromatic image to the sheet S transported to the secondary transfer region TR2. Thus is obtained a print of the monochromatic image.

The embodiment manages a timing of feeding the sheet S to the secondary transfer region TR2 in order to ensure that the image on the intermediate transfer belt 71 is transferred exactly to a predetermined place on the sheet S. Specifically, a gate roller 81 is provided on the transport path F at place upstream from the secondary transfer region TR2, as shown in FIG. 1. The gate roller 81 is rotated as timed to the cycling motion of the intermediate transfer belt 71, thereby feeding the sheet S to the secondary transfer region TR2 in a predetermined timing.

The sheet S thus formed with the color image or the monochromatic image is transported to a discharge tray 89 via a fixing unit 9, a pre-discharge roller 82 and a discharge roller 83, the discharge tray disposed on an upper side of the apparatus body 120. In a case where the image is formed on both sides of the sheet S, the rotation of the discharge roller 83 is reversed at a point of time that a trailing end of the sheet S formed with the image on one side thereof is transported to a reversal position PR, so that the sheet S is transported along a reversal transport path FR in a direction of an arrow D3. Thereafter, the sheet S is loaded again on the transport path F at place upstream from the gate roller 81. At this time, the sheet S is positioned in a manner that its side opposite from the side previously formed with the image is pressed against the intermediate transfer belt 71 in the secondary transfer region TR2 so as to be transferred with the image. In this manner, the image may be formed on the both sides of the sheet S.

In FIG. 3, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

FIGS. 6A and 6B are schematic diagrams each showing the operations of the image forming apparatus of FIG. 1. The image forming apparatus carries out the color print mode or the monochromatic print mode according to the print command applied from the external apparatus. In the interest of clarity of the features of the invention, description will be made on separate cases which include: (a) a case where a color print command for successively making prints of A4-size color images is applied from the external apparatus; and (b) a case where a monochromatic print command for successively making prints of A4-size monochromatic images is applied from the external apparatus.

(a) Color Print Mode

When the aforesaid color print command is applied from the external apparatus, the CPU converts the color print command into job data in a format suited for directing the operations of the engine EG and sends the job data to the engine controller 10. The engine controller 10, in turn, controls the individual parts of the engine EG based on the job data sent from the CPU 111, so that a color image is formed on the intermediate transfer belt 71. Specifically, the color image is formed by performing (a-1) an image forming process to form a black toner image, (a-2) an image forming process to form a cyan toner image, (a-3) an image forming process to form a magenta toner image, and (a-4) an image forming process to form a yellow toner image.

(a-1) Image Forming Process to Form Black Toner Image

In this process, the black developer 4K is transferred to the development position. On the other hand, electrostatic latent images for black color are formed on the photosensitive member 22 and then are developed by the developer 4K so as to form toner images TIk1, TIk2. The resultant toner images TIk1, TIk2 are transferred onto the intermediate transfer belt 71 moved in the moving direction D2. Thus, two black toner images TIk1, TIk2 are arranged in the transfer permission region 716 of the intermediate transfer belt 71 along the moving direction D2 as spaced away from each other by a first spacing d1(*a*). In the latter half of the image forming process, a movement for making changeover to the developer 4C of the next toner color is started.

(a-2) Image Forming Process to Form Cyan Toner Image

When the cyan developer 4C is transferred to the development position, the drivable rotation of the developing unit 4 is stopped. On the other hand, electrostatic latent images for cyan color are formed on the photosensitive member 22 and then are developed by the developer 4C so as to form toner images TIc1, TIc2. The resultant toner images TIc1, TIc2 are transferred onto the intermediate transfer belt 71 in a manner to be superimposed on the toner images TIk1, TIk2. Hence, an intermediate image formed by superimposing the toner image TIc1 on the toner image TIk1 and an intermediate image formed by superimposing the toner image TIc2 on the toner image TIk2 remain to be spaced away from each other by the first spacing d1(*a*). In this respect, the same holds for the subsequent image forming processes. In FIG. 6, parenthesized characters represent toner images already transferred onto the intermediate transfer belt 71. In the latter half of the image forming process, a movement for making changeover to the developer 4M of the next toner color is started.

(a-3) Image Forming Process to Form Magenta Toner Image

When the magenta developer 4M is transferred to the development position, the drivable rotation of the developing unit 4 is stopped. On the other hand, electrostatic latent images for magenta color are formed on the photosensitive member 22 and then are developed by the developer 4M so as to form toner images TIm1, TIm2. The resultant toner images TIm1, TIm2 are transferred onto the intermediate transfer belt 71 in a manner to be superimposed on the intermediate images. In the latter half of the image forming process, a movement for making changeover to the developer 4Y of the next toner color is started.

(a-4) Image Forming Process to Form Yellow Toner Image

When the magenta developer 4Y is transferred to the development position, the drivable rotation of the developing unit 4 is stopped. On the other hand, electrostatic latent images for yellow color are formed on the photosensitive member 22 and then are developed by the developer 4Y so as to form toner images TIy1, TIy2. The resultant toner images TIy1, TIy2 are transferred onto the intermediate transfer belt 71 in a manner to be superimposed on the intermediate images. These four image forming processes are repeated in cycles thereby to superimpose the toner images of four colors on top of each other on the intermediate transfer belt 71, whereby two color images are formed as spaced away from each other by the first spacing d1(*a*) along the moving direction D2.

In the color print mode, the positions for toner images transfer onto the intermediate transfer belt 71 are adjusted such that the first spacing d1(*a*) is shorter than a second spacing d2(*a*). It is noted here that the "second spacing d2" means a distance between the final image formed in the preceding image forming process and the first image formed in the succeeding image forming process.

According to the embodiment, the second spacing d2(*a*) may be increased by the amount that the first spacing d1(*a*) is decreased, so that a sufficient time for the changeover of the developers 4Y, 4M, 4C, 4K may be attained. This permits the reduction of the moving speed of the developers 4Y, 4M, 4C, 4K transferred for changeover. As a result, the developers 4Y, 4M, 4C, 4K may be moved in a stable manner. This embodiment, in particular, employs the intermediate transfer belt 71 including the seams 711, so that it is required to locate the images out of the seams. In this respect, the embodiment proves itself to be effective for the following reason.

The image forming apparatus of FIG. 1 requires the images to be located in the area (transfer permission region) between the seam 711 and the seam 711 and each of the image forming processes (a-1) to (a-4) to be performed in each moving period of the intermediate transfer belt 71. In such a case where the restrictions are imposed on the image placement area, the only way to expand the second spacing d2(*a*) is to decrease the first spacing d1(*a*). In this respect, the same holds for an image forming apparatus performing the image forming process in synchronism with the vertical synchronous signal, although the apparatus employs an intermediate transfer belt free from the seams.

(b) Monochromatic Print Mode

When the aforesaid monochromatic print command is sent from the external apparatus, the CPU converts the monochromatic print command into job data in a format suited for directing the operations of the engine EG and sends the job data to the engine controller 10. The engine controller 10, in turn, controls the individual parts of the engine EG based on the job data sent from the CPU 111, so that a monochromatic image is formed on the intermediate transfer belt 71. Specifically, with the black developer 4*k* transferred to the development position, an image forming process to be described as below is repeated in cycles thereby successively forming monochromatic images I1–I8.

In each image forming process, monochromatic images are formed in pairs. More specifically, the first image forming process is performed the same way as the aforementioned process (a-1) thereby forming two monochromatic images I1, I2. That is, electrostatic latent images for black are formed on the photosensitive member 22 and then are developed by the developer 4K so as to form toner images TIk1, TIk2. The toner images TIk1, TIk2 are transferred onto the intermediate transfer belt 71 moved in the moving direction D2. Thus, two black toner images TIk1, TIk2, as a first and a second monochromatic image 11, 12, are formed in the transfer permission region 716 of the intermediate transfer belt 71. The subsequent image forming processes are performed the same way so as to form monochromatic images I3, I4, . . . .

This embodiment is arranged such that the first spacing differs between the monochromatic print mode and the color print mode. That is, the monochromatic print mode makes adjustment such that the first spacing d1(*b*) and the second spacing d2(*b*) are of the same value. In the monochromatic print mode, the monochromatic images formed on the intermediate transfer belt 71 are immediately subjected to the secondary image transfer to the sheet S. This dictates the need for successively feeding the sheets S to the secondary transfer region TR2 in synchronism with the image formation as described above. In such a case where the successive sheet feeding is continued, it is crucial to prevent the jamming of the sheet S. On this account, the aforementioned adjustment may be made to equate the first spacing d1(*b*) to the second spacing d2(*b*), thereby obviating a narrowed sheet spacing. Hence, the occurrence of sheet jam may be avoided. In a case where double-side printing is performed on the sheet S, a sheet printed on one side thereof must be registered with an image on the intermediate transfer belt 71. In this respect, as well, the adjustment to equate the first spacing d1(*b*) to the second spacing d2(*b*) facilitates the registration of the sheet S having the monochromatic image printed on one side thereof.

As described above, the embodiment is adapted to provide controls suited for the individual print modes because the embodiment is arranged such that when plural images are arranged on the intermediate transfer belt 71, the first spacing d1 between the images is varied depending upon the print mode. Specifically, when the color print mode is carried out, the images are arranged on the intermediate transfer belt 71 with such a first spacing d1(*a*) as to be suited for the color print mode or at such a space interval as to take into account the changeover of the developers. Thus, the embodiment may afford the aforementioned working effect (stable developer changeover performance). On the other hand, the monochromatic print mode is carried out differently from the color print mode. That is, the images are arranged on the intermediate transfer belt 71 at a space interval adapted to prevent the jamming of the sheet S. Thus, the embodiment may afford the aforementioned working effect (jam prevention effect).

It is to be noted that the invention is not limited to the aforementioned first embodiment and various other changes than the above may be made so long as such changes do not depart from the scope of the invention. In the above first embodiment, for example, two images are arranged on the intermediate transfer belt 71 along the moving direction D2. However, the invention is also applicable to an image forming apparatus wherein three or more images are arranged on the intermediate transfer belt. In short, the invention is applicable to the all types of image forming apparatuses wherein N ($N \geqq 2$) images are arranged on the intermediate transfer belt 71 along the moving direction D2. The image forming apparatuses of this type may offer the same working effects as those of the first embodiment by varying the first spacing between the aforesaid color print mode and the aforesaid monochromatic print mode, the first spacing defined between the M-th image (M representing a natural number of less than N) and the M+1-th image.

While the first embodiment employs the intermediate transfer belt as the toner image carrier, the toner image carrier is not limited to this. The invention is also applicable to an image forming apparatus employing a transfer drum or transfer sheet as the toner image carrier.

While the first embodiment is adapted to transfer any one of the four developers 4Y, 4M, 4C, 4K to the predetermined development position by way of a rotary drive system, the number of the developers is not limited to "4". The invention is applicable to the all types of image forming apparatuses adapted to transfer two or more developers. The changeover drive system is not limited to the rotary system. The invention is also applicable to an image forming apparatus wherein the changeover of the developers is accomplished by selectively transferring any one of the developers to the development position.

Second Embodiment

Next, description will be made on a second embodiment of the invention. The basic arrangement of an image forming apparatus according to the second embodiment is the same as that of the first embodiment. Therefore, like parts of the apparatus are represented by the same reference numerals, respectively, and the description on the mechanical and electrical arrangements thereof is dispensed with.

Figure 7:
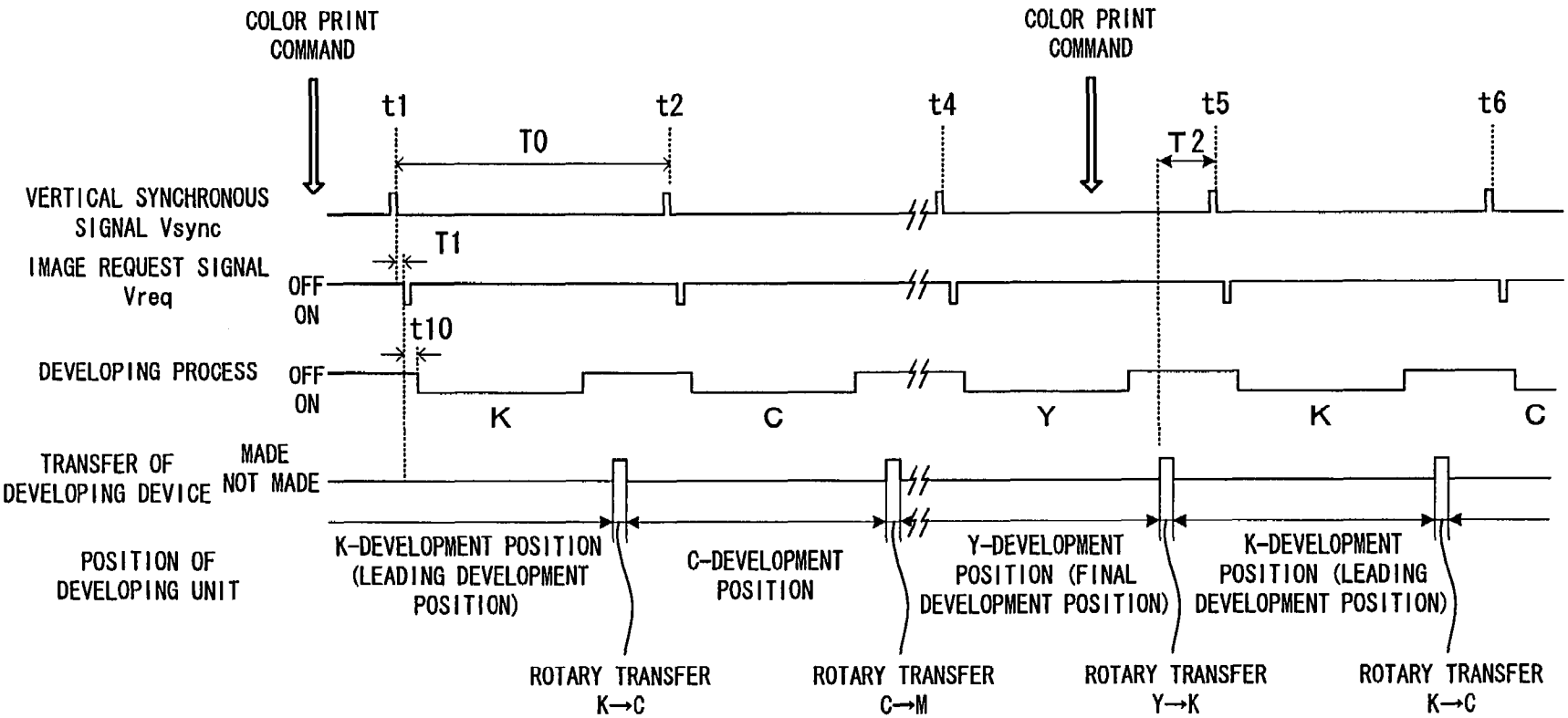
FIGS. 7 to 9 are timing charts each showing the operations of an image forming apparatus according to a second embodiment of the invention.
Figure 8:
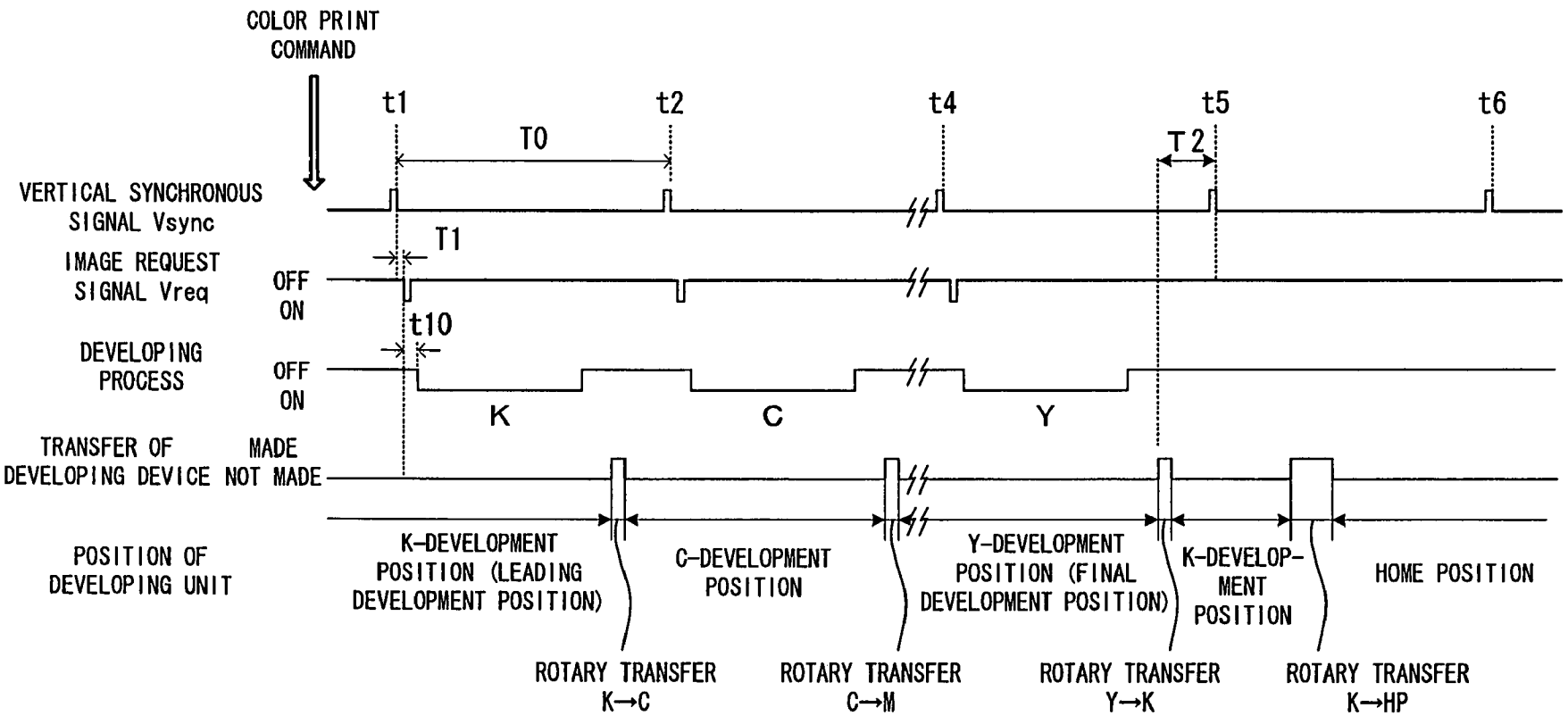
Figure 9:
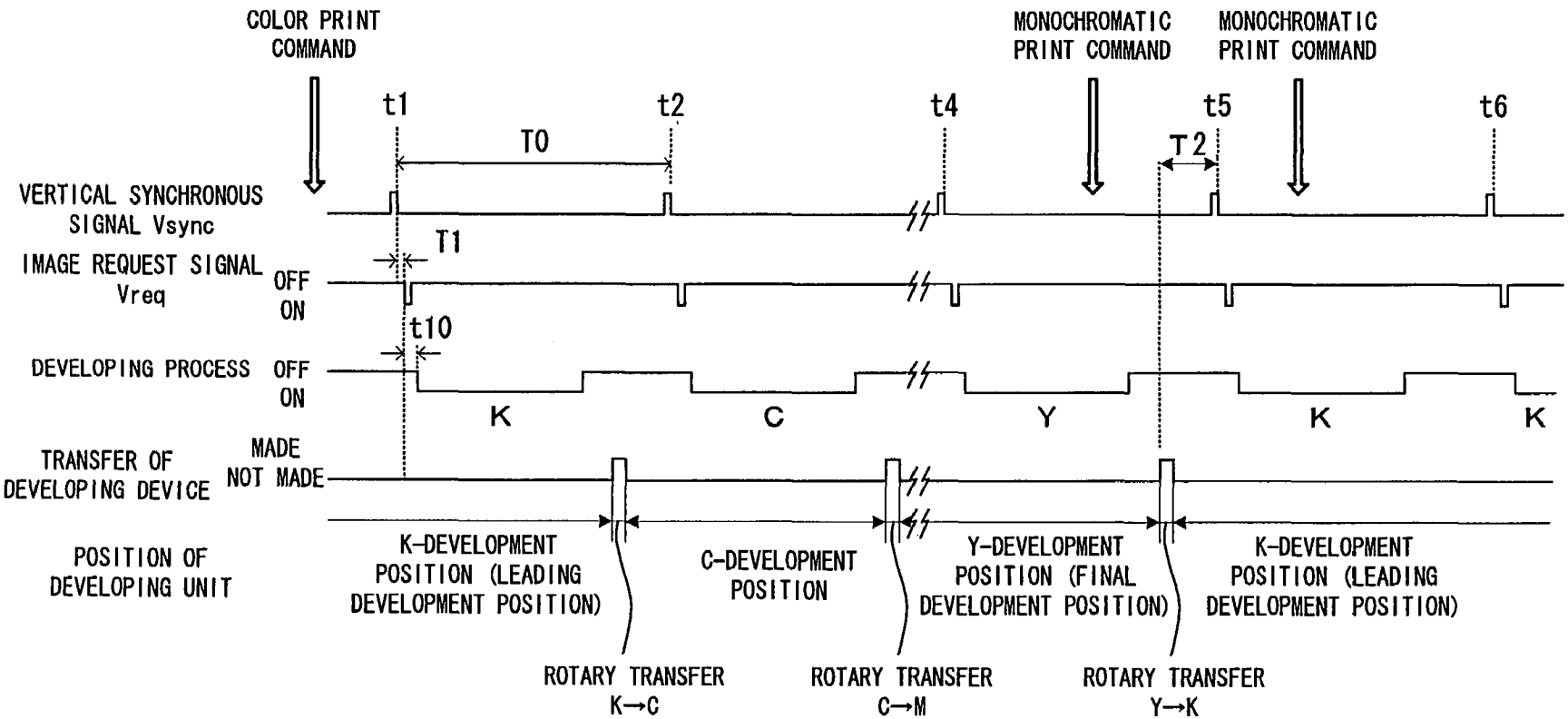

FIGS. 7 to 9 are timing charts each showing the operations of the image forming apparatus according to the second embodiment of the invention. The image forming apparatus operates as follows. In response to a color print signal from the external apparatus, the CPU 111 of the main controller 11 converts the color print signal into job data in a format suited for directing the operations of an engine EG and then outputs the resultant color print command to the engine controller 10. The engine controller 10, in turn, controls the individual parts of the engine EG based on the color print command whereby the color print mode is carried out. When, on the other hand, a monochromatic print signal is applied from the external apparatus, the CPU 111 outputs a monochromatic print command to the engine controller 110. The engine controller 10, in turn, controls the individual parts of the engine EG based on the monochromatic print command whereby the monochromatic print mode is carried out. In the interest of clarity of the features of the invention, description will be made on separate cases which include: (a) a case where color images are successively printed (FIG. 7); (b) a case where a color image is printed on only one sheet (FIG. 8); and (c) a case where printing of a color image is followed by successive printing of monochromatic images.

(a) Successive Printing of Color Images (FIG. 7)

When a color print command for the first sheet is applied from the main controller 11, the engine controller 10 carries out the color print mode based on the vertical synchronous signal Vsync. Specifically, at each time t1, t2, . . . , or each time the intermediate transfer belt 71 makes one cycling motion (period T0), the vertical synchronous sensor 77 outputs the vertical synchronous signal Vsync, which is used as a reference signal for the operations of the individual parts of the engine EG. After a lapse of a given time period T1 from time t1 when the vertical synchronous signal Vsync falls, an image request signal Vreq is outputted to the main controller 11. Based on the image request signal Vreq, the main controller 11 outputs an image signal at time t10. The engine controller 10 drives the exposure unit 6 in synchronism with the image signal, so that, at time t10, the exposure unit starts an exposure process corresponding to a toner image. At this time, the developing unit 4 is already transferred to the K-development position shown in FIG. 4B in response to the color print command. Thus, the developing roller 41K provided at the developer 4K of black as the leading color of the color print mode is brought into face-to-face relation with the photosensitive member 22. As maintained at the leading development position, the developing unit 4 performs a developing process following the exposure process. When the developing process is completed, the developing unit 4 is rotated so as to be transferred the next development position as shown in a bottom row in FIG. 7.

Subsequently, the exposure, developing and transfer processes are performed at respective times t2, . . . , t4 associated with the cyan color (C), the magenta color (M) and the yellow color (Y), the processes performed the same way as the processes for the black color (K). According to this embodiment, when the developing process for the yellow color as the final color of the color print mode is completed, the CPU 101 of the engine controller 10 rotates the developing unit 4 to transfer the same from the final development position to the leading development position, as shown in the bottom row in FIG. 7, regardless of whether the next print command is applied in succession or not. This brings the developing roller 41K of the developer 4K of black as the leading color of the color print mode into the face-to-face relation with the photosensitive member 22. Thus, the apparatus is ready to perform the printing operations just after the receipt of a print command.

In parallel with the aforementioned changeover of the developing unit 4 from the K-development position (the leading development position)→a C-development position→an M-development position→a Y-development position (the final development position), determination is made as to whether or not the next print command is received within the lapse of a given time period T2 from the completion of the yellow developing process. In short, the determination is made as to whether or not the print command is received before the next vertical synchronous signal Vsync falls. According to the operation mode shown in FIG. 7, the next color print command is applied before time t5. Hence, it is determined that the next print command is received and the color print mode for the second sheet is carried out.

At time t5, the developing unit 4 is already positioned at the leading development position, so that the apparatus in this state may carry out the color print mode for the second sheet. Thus, the successive printing is efficiently performed. On the other hand, in a case where the next print command is not received before time t5, the developing unit 4 positioned at the leading development position is further rotated to the home position (standby position) shown in FIG. 4A, as will be described hereinlater. At this position, the developing unit waits for the subsequent print command.

(b) Printing of Color Image on only One Sheet (FIG. 8)

When a color print command is applied, the same procedure as the above is taken to print a color image on the first sheet. Specifically, toner images of four colors are formed by performing the developing process each time the developing unit 4K is transferred to the K-development position (the leading development position)→the C-development position→the M-development position→the Y-development position (the final development position) in this order. In the meantime, the toner images of four colors are superimposed on top of each other on the intermediate transfer belt 71 so as to form the color image. When the yellow developing process is completed, the developing unit 4 is rotated from the final development position to the leading development position, as shown in a bottom row in FIG. 8, regardless of whether the next print command is successively applied or not. In a case where the next print command is not yet received when time has elapsed to time t5, the developing unit 4 is rotated from the leading development position to the home position.

(c) Successive Printing of Monochromatic Images Following Color Image Printing (FIG. 9)

While the foregoing description has been made on the color printing, there may be a case where the color printing is succeeded by a request for the monochromatic printing. In this case, the color print mode and the monochromatic print mode are successively carried out in timings as shown in FIG. 9, for example. First, the color printing is performed the same way as in the aforementioned cases. When the yellow developing process is completed, the developing unit 4 is rotated from the final development position to the leading development position, as shown in a bottom row in FIG. 9, regardless of whether the next print command is successively applied or not. According to the embodiment, black is the color used in the monochromatic printing, which is a "specific color" of the invention. That is, the specific color of the invention is the same as the leading color of the color print mode. Therefore, the developing roller 41K provided at the developer 4K of black as the leading color of the monochromatic print mode is brought into the face-to-face relation with the photosensitive member 22. Thus, the apparatus is ready to perform the monochromatic printing operations just after the receipt of the monochromatic print command.

If the monochromatic print command is applied as a "succeeding print command" of the invention before time t5, it is thus determined that the next print command is received and then, the monochromatic print mode is carried out. Where monochromatic print commands are successively applied, the developing processes are successively performed with the developing unit 4 positioned at the leading development position.

According to the embodiment, as described above, the determination is made as to whether or not the next print command is received within the lapse of the given time period T2 from the completion of the developing process for the final color (yellow) which is performed in the final stage of the color print mode. If the next print command is received, the color print mode is carried out based on the received print command. If, on the other hand, the next print command is not received, the developing unit 4 is moved to the predetermined home position (standby position). That is, the embodiment does not monotonously controllably drive the developing unit 4 as soon as the developing process for the final color is completed. Instead, the embodiment provides the control of the rotatable movement of the developing unit 4 after making a check for the receipt of the next print command. Therefore, the developing unit 4 may be operated in a mode adapted for each of the cases where the print commands are successively applied and where the print commands are applied in a non-successive manner. As a result, the printing operations may be efficiently performed in both the cases of the successive printing and the non-successive printing.

When the developing process for the final color is completed, the developing unit 4 is driven to position the black developer 4K at the development position regardless of whether the next print command is received or not. Then, the determination is made as to whether the next print command is received or not. Accordingly, the black developer 4K is already positioned at the development position when the next color print mode is carried out after the determination that the next print command is received. This permits the black developing process to be performed immediately and hence, even more efficient printing operations may be accomplished. In a case where a monochromatic print command is applied as the next print command, as well, the black developer 4K in an as-is state may be used to perform the developing process. Therefore, the printing operations may be performed even more efficiently.

According to the embodiment, as shown in FIGS. 4A to 4D, the developing unit 4 is rotated in the predetermined direction D5 so as to be positioned at the final development position (FIG. 4C), the leading development position (FIG. 4B) and the home position (FIG. 4A) in the order named. Furthermore, after the completion of the developing process for the final color, the developing unit 4 is rotated to be positioned at the leading development position regardless of whether the succeeding print command is received or not. Therefore, the developing unit 4 is necessarily positioned at the leading development position after the completion of the developing process for the final color in both the cases where the next print command is successively applied (successive printing) and where the next print command is not applied in succession (non-successive printing). As a result, the developing unit 4 is rotatably moved in a reasonable manner so that the printing operations may be performed efficiently regardless of whether the print commands are successively applied or not.

In this apparatus, a check for the receipt of the succeeding print command may be made within the lapse of the given time period from the completion of the developing process for the final color, for example. If the succeeding print command is received, the developer positioned at the leading development position can immediately perform the developing process. If the succeeding print command is not received, the developing unit 4 may be moved from the leading development position to the standby position. Thus, the developing unit 4 can be moved to the standby position via the shortest course.

It is to be noted that the invention is not limited to the aforementioned second embodiment and various other changes than the above may be made so long as such changes do not depart from the scope of the invention. In the second embodiment, for example, the developing processes are performed in the order of black, cyan, magenta and yellow but the order of the colors is not limited to this. The invention is applicable to the all types of image forming apparatuses including the rotary developing unit. Furthermore, the type of the toner or the number of toners is not limited to the foregoing embodiments. The invention is applicable to the all types of image forming apparatuses adapted to form the color image by using a plurality of developers individually containing toners of different colors.

According to the second embodiment, time T2 is defined as the "given time period from the completion of the developing process for the final color" such that the check for the succeeding print command may be made in synchronism with the succeeding vertical synchronous signal Vsync. However, the synchronization is not prerequisite and the aforesaid given time period may be defined arbitrarily. However, in a case where the aforesaid given time period is defined to be longer than time T2, a print command received after time t5 must be executed based on a vertical synchronous signal outputted at the subsequent time t6. This results in a need to idle the intermediate transfer belt 71 thorough one cycling motion.

<Miscellaneous>

The foregoing first and second embodiments define black as the "specific color" of the invention which is used for forming the monochromatic image. However, the invention is also applicable to an image forming apparatus which defines another toner color as the "specific color" used for forming the monochromatic image. The image forming apparatus includes the all types of image forming apparatuses such as copiers and facsimiles.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

an engine which performs an image forming process in which a toner image is formed by developing a latent image on a latent image carrier by means of any one of a plural developers that is positioned at a predetermined development position, and transferred onto a toner image carrier moved in a given moving direction; and a controller which selectively carries out a monochromatic print mode, in which a monochromatic image is formed by performing said image forming process for a specific color, or a color print mode in which a color image is formed by the steps of forming plural toner images by performing said image forming process at each changeover of plural developers and of superimposing said plural toner images on top of each other on an image carrier, wherein said engine arranges N images, wherein n>2, on said toner image carrier along said moving direction, and said controller adjusts a first spacing between the M-th image and the (M+1)-th image, wherein M represents a natural number of less than N, so that said color print mode and said monochromatic print mode are different from each other in said first spacing.

2. The image forming apparatus as claimed in claim 1, wherein said engine successively performs two image forming processes, and in said color print mode said controller adjusts said first spacing to be shorter than a second spacing which is defined as a distance between the N-th image arranged on said toner image carrier in the preceding image forming process and the first image arranged on said toner image carrier in the succeeding image forming process.

3. The image forming apparatus as claimed in claim 1, wherein said engine successively performs two image forming processes, and in said monochromatic print mode said controller adjusts said first spacing and said second spacing to be of an equal value.

4. The image forming apparatus as claimed in claim 1, wherein said toner image carrier comprises an endless structure with seams which is formed by joining together sheet members at respective opposite ends thereof, the sheet member capable of carrying the toner image on a central portion of its surface, and said engine transfers the toner image on said latent image carrier to said central portion of the surface.

5. The image forming apparatus as claimed in claim 1, further comprising a detector which detects a detection object provided at said toner image carrier, wherein said engine performs said image forming process in synchronism with a detection result given by said detector.

6. An image forming method for forming an image by performing an image forming process including a step of forming a toner image by developing a latent image on a latent image carrier by means of any one of plural developers that is positioned at a predetermined development position and a step of transferring the resultant toner image onto a toner image carrier moved in a given moving direction, said method comprising:

a step of selecting either a monochromatic print mode or a color print mode, said monochromatic print mode in which a monochromatic image is formed by performing said image forming process for a specific color, said color print mode in which a color image is formed by the steps of forming plural toner images by performing said image forming process at each changeover of said plural developers and of superimposing said plural toner images on top of each other on said toner image carrier; and a step of performing said selected print mode, wherein when N images, wherein N≧2, are arranged on said image carrier along said moving direction, a first spacing between the M-th image and the (M+1)-th image, whrein M represents a natural number of less than N, is adjusted to differ between said color print mode and said monochromatic print mode.

7. An image forming apparatus comprising:

a latent image carrier capable of carrying a latent image thereon; and a developing unit which includes a plurality of developers, each of which develops the latent image on said latent image carrier by individually using toners of different colors, and a support member which supports said plural developers and rotates about a predetermined axis, wherein a color print mode is carried out in which a plural toner images form by performing a developing process each time any one of said plural developers is positioned at a predetermined development position according to a print command and in which the plural toner images are superimposed on top of each other, said developing process being defined as a step of forming the toner image by developing the latent image on said latent image carrier by means of any one of said plural developers that is positioned at said development position by rotatably moving said developing unit, a check for the receipt of the succeeding print command is made within the lapse of a given time period from the completion of the developing process for a final color which is executed lastly of said plural colors, and if the print command is received, the color print mode is carried out based on the received print command whereas if the print command is not received, said developing unit is moved to a predetermined standby position.

8. The image forming apparatus as claimed in claim 7, wherein after the completion of the developing process for said final color, said developing unit is rotatably moved for positioning a developer of a leading color at said development position, the leading color executed firstly of said plural colors, and then, a check is made for the presence of said received print command.

9. The image forming apparatus as claimed in claim 8, wherein either a monochromatic print mode or said color print mode is selectively carried out according to the print command, said monochromatic print mode in which a monochromatic image is formed by performing said developing process for a specific color of said plural colors, and said leading color is said specific color.

10. The image forming apparatus as claimed in claim 9, wherein said specific color is black.

11. The image forming apparatus as claimed in claim 7, wherein either a monochromatic print mode or said color print mode is selectively carried out according to the print command, said monochromatic print mode in which a monochromatic image is formed by performing said developing process for a specific color of said plural colors, and after the completion of the developing process for said final color, said developing unit is rotatably moved for positioning the developer of said specific color at said development position, and then a check is made for the presence of said received print command.

12. An image forming apparatus comprising:

a latent image carrier capable of carrying a latent image thereon; and a developing unit which includes a plurality of developers, each of which develops the latent image on said latent image carrier by individually using toners of different colors, and a support member which supports said plural developers and rotates about a predetermined axis, wherein a color print mode is carried out in which a plural toner images form by performing a developing process each time any one of said plural developers is positioned at a predetermined development position according to a print command and in which the plural toner images are superimposed on top of each other, said developing process being defined as a step of forming the toner image by developing the latent image on said latent image carrier by means of any one of said plural developers that is positioned at said development position by rotatably moving said developing unit, said developing unit is rotatably moved thereby being positioned at a final development position, a leading development position and a standby position in the order named, said leading development position being defined as a position at which said developing unit presents to said development position a developer of a leading color executed firstly of said plural colors, said final development position being defined as a position at which said developing unit presents to said development position a developer of a final color executed lastly of said plural colors, said standby position being defined as a position at which said developing unit waits for a print command, and after the completion of the developing process for said final color, said developing unit is rotatably moved to be positioned at a leading development position regardless of whether the succeeding print command is received or not.

13. The image forming apparatus as claimed in claim 12, wherein a check for the receipt of the succeeding print command is made within the lapse of a given time period from the completion of the developing process for said final color, and if the print command is received, the developing process is performed by means of a developer positioned at said leading development position, whereas if the print command is not received, said developing unit is moved from said leading development position to said standby position.

14. The image forming apparatus as claimed in claim 13, wherein either a monochromatic print mode or said color print mode is selectively carried out according to the print command, said monochromatic print mode in which a monochromatic image is formed by performing said developing process for a specific color of said plural colors, and said leading color is said specific color.

15. The image forming apparatus as claimed in claim 14, wherein said specific color is black.

16. A method of forming an image by an apparatus which comprises: a latent image carrier capable of carrying a latent image thereon; and a developing unit which includes a plurality of developers, each of which develops the latent image on said latent image carrier by individually using toners of different colors, and a support member which supports said plural developers and rotates about a predetermined axis, said method comprising:

a first step of forming a color image by carrying out a color print mode in which a plural toner images form by performing a developing process each time any one of said plural developers is positioned at a predetermined development position according to a print command and in which the plural toner images are superimposed on top of each other, said developing process being defined as a step of forming the toner image by developing the latent image on said latent image carrier by means of any one of said plural developers that is positioned at said development position by rotatably moving said developing unit;

a second step of checking for the receipt of the succeeding print command within the lapse of a given time period from the completion of a developing process for a final color performed lastly in said first step;

a third step following the determination that the succeeding print command is received and performed to carry out the color print mode corresponding to the received print command; and a fourth step following the determination that the succeeding print command is not received and performed to move said developing unit to a predetermined standby position.

* * * * *